US010537415B2

(12) United States Patent
Yoshime Watanabe

(10) Patent No.: US 10,537,415 B2
(45) Date of Patent: Jan. 21, 2020

(54) ARTIFICIAL INSEMINATION DEVICE

(71) Applicant: Osnir Yoshime Watanabe, Cravinhos-SP (BR)

(72) Inventor: Osnir Yoshime Watanabe, Cravinhos-SP (BR)

( * ) Notice: Subject to any disclaimer, the term of this patent is extended or adjusted under 35 U.S.C. 154(b) by 231 days.

(21) Appl. No.: 15/580,835

(22) PCT Filed: Jun. 8, 2016

(86) PCT No.: PCT/BR2016/050131

§ 371 (c)(1),
(2) Date: Dec. 8, 2017

(87) PCT Pub. No.: WO2016/197220

PCT Pub. Date: Dec. 15, 2016

(65) Prior Publication Data

US 2018/0333245 A1 Nov. 22, 2018

(30) Foreign Application Priority Data

Jun. 8, 2015 (BR) ..... 202015013343

(51) Int. Cl.
*A61D 19/02* (2006.01)

(52) U.S. Cl.
CPC ..... *A61D 19/02* (2013.01)

(58) Field of Classification Search
CPC .... A61B 17/43; A61B 10/0291; A61D 19/00; A61D 19/024; A61D 7/00; A61D 19/022; A61D 19/02; A61D 19/027
See application file for complete search history.

(56) References Cited

FOREIGN PATENT DOCUMENTS

| | | |
|---|---|---|
| CN | 2525951 | 12/2002 |
| CN | 102670329 | 9/2012 |
| CN | 203576691 | 5/2014 |
| MU | 7902479 | 5/2001 |

OTHER PUBLICATIONS

International Search Report prepared by the Instituto Nacional Da Propriedade Industrial for International Application No. PCT/BR2016/050131, dated Aug. 31, 2016.
English Translation of Written Opinion for International (PCT) Patent Application No. PCT/BR2016/050131, dated Aug. 31, 2016, 6 pages.

*Primary Examiner* — Christine H Matthews
(74) *Attorney, Agent, or Firm* — Sheridan Ross PC

(57) ABSTRACT

It refers to an artificial insemination device which comprises a tube and a tip engageable at one end of the tube, the tip being formed by a hollow tubular body with a semi-spherical upper end provided with at least three orifices; the tip internally comprises at least a first frustoconical portion tapering towards the upper end for insertion of a first vane containing biological material to be inseminated, followed by a first annular portion for coupling this vane, a second frustoconical portion tapering toward the upper end, arranged next to the first annular portion for insertion of a second vane containing biological material having a smaller diameter than the first vane, a second annular portion, arranged after the second additional frustoconical portion, for coupling with the second vane smaller than the first one, and a niche in the region of the upper semi-spherical end where the at least three orifices are arranged.

13 Claims, 6 Drawing Sheets

ARTIFICIAL INSEMINATION DEVICE

CROSS REFERENCE TO RELATED APPLICATIONS

Figure 1:
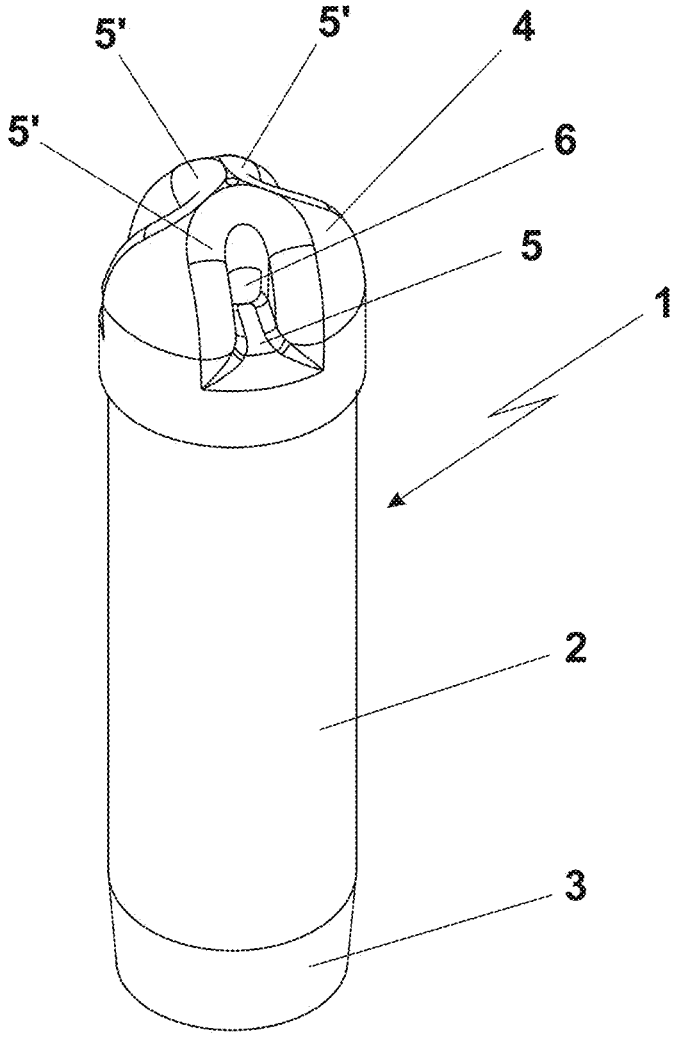

This application is a national stage application under 35 U.S.C. 371 and claims the benefit of PCT Application No. PCT/BR2016/050131 having an international filing date of 8 Jun. 2016, which designated the United States, which PCT application claimed the benefit of Brazil Patent Application No. 202015013343-5 filed 8 Jun. 2015, the disclosure of each of which are incorporated herein by reference.

The present patent is a utility model of a new shape and arrangement introduced into an artificial insemination device belonging to the veterinary technical sector, more particularly, it relates to a device comprising a tip that is engaged in a tube, forming an artificial insemination sheath with the function of coupling the vane with biological material, directing the semen according to the exits inside the animal's uterus and, with its anatomical shape, facilitating the introduction of the sheath without hurting the animal, through which extremely advantageous practical, safe and functional results are obtained.

Artificial insemination sheaths with plastic tip welded at the tube end with two outlets and plunger insemination sheaths are known in the market. For two-outlet welded-tip sheaths, the semen exit orifice is lateral, forming an angle of 90° with the axis of the sheath, one of the drawbacks of this part model being its manufacturing process, which requires a more complex injection mold with drawers. Another detail is that, at the time of application in the animal, the biological material exits through the two sides of the tip at 90 degrees of inclination, which does not allow distribution and diffusion of the semen inside the animal's uterus and, thus, does not contribute to increase the chances of fertilization occurring. A third drawback of these known artificial insemination sheaths is that they involve a high reflux rate of the biological material at the time of insemination, which means that between about 16% and 88% of the semen is retained within the sheath tip, mainly when the insemination is carried out quickly and in a jet, due to the inadequate fit between the vane with semen and the insemination sheath.

The plunger insemination sheath has no type of tip welded at the tube end but has one of its tips shaped to create an anatomy suitable for application to the animal and serves as a stopper for the plunger receiving the vane with the biological material. In this model, at the moment of application, the material follows in a single frontal orifice, being expelled straight in the direction of the axis of the sheath, which also does not provide adequate distribution and diffusion of the semen inside the animal's uterus. By this arrangement, the semen jet can be directed only to one of the two uterine horns of the animal. However, if ovulation occurs only in the other horn, the chances of fertilization are reduced.

Thus, the purpose of the artificial insemination device, object of this utility model, is to allow a better distribution of the biological material when inseminated, allowing a better use thereof, besides allowing the use of vanes of different diameters, solving the aforementioned drawbacks, and to provide other advantages deriving from its design.

The device according to this model will be better understood through the accompanying drawings, which schematically represent:

FIG. 1—perspective view of the new constructive arrangement introduced in an artificial insemination device.

Figure 2:
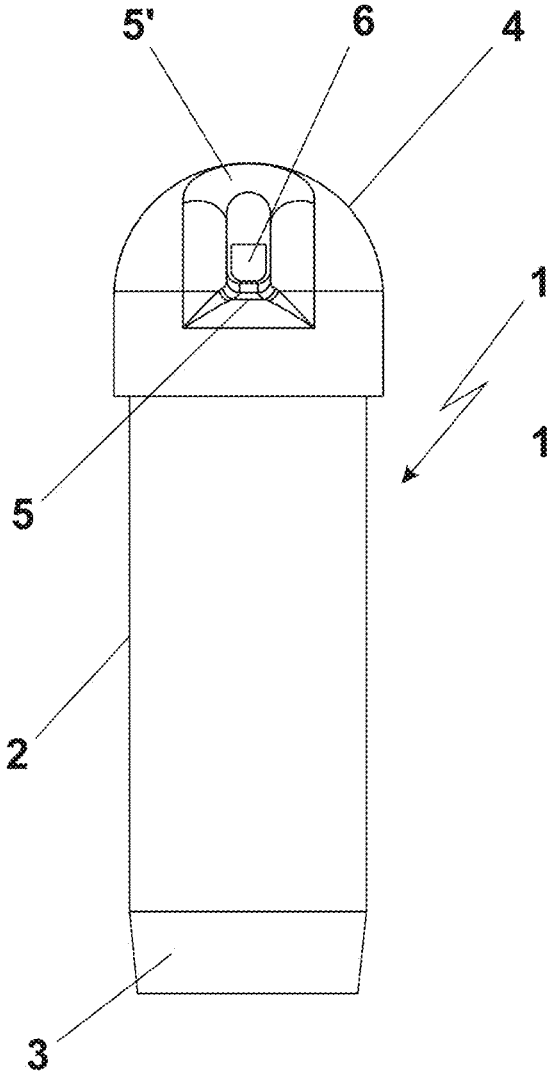
Figure 3:
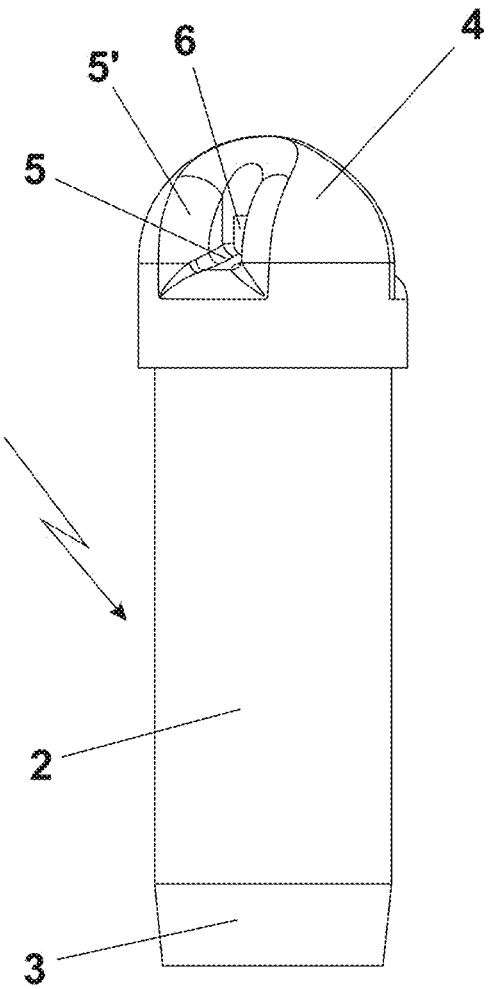
Figure 4:
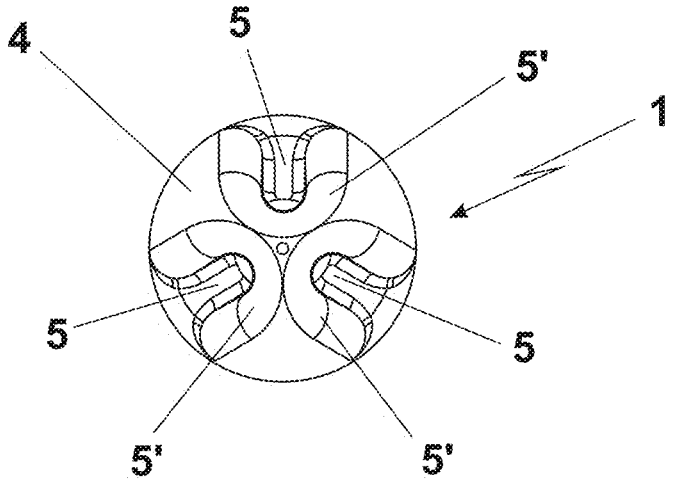
Figure 5:
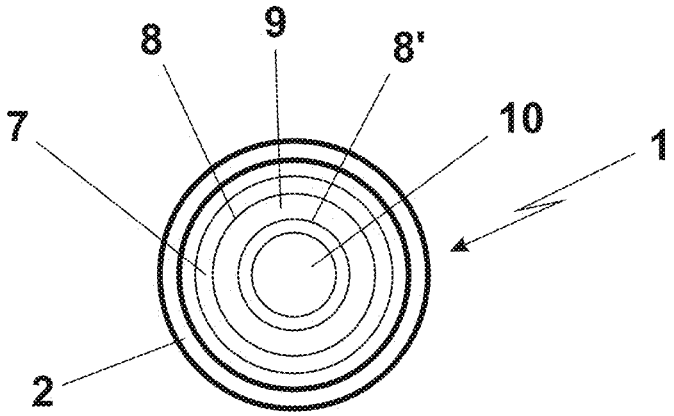
Figure 6:
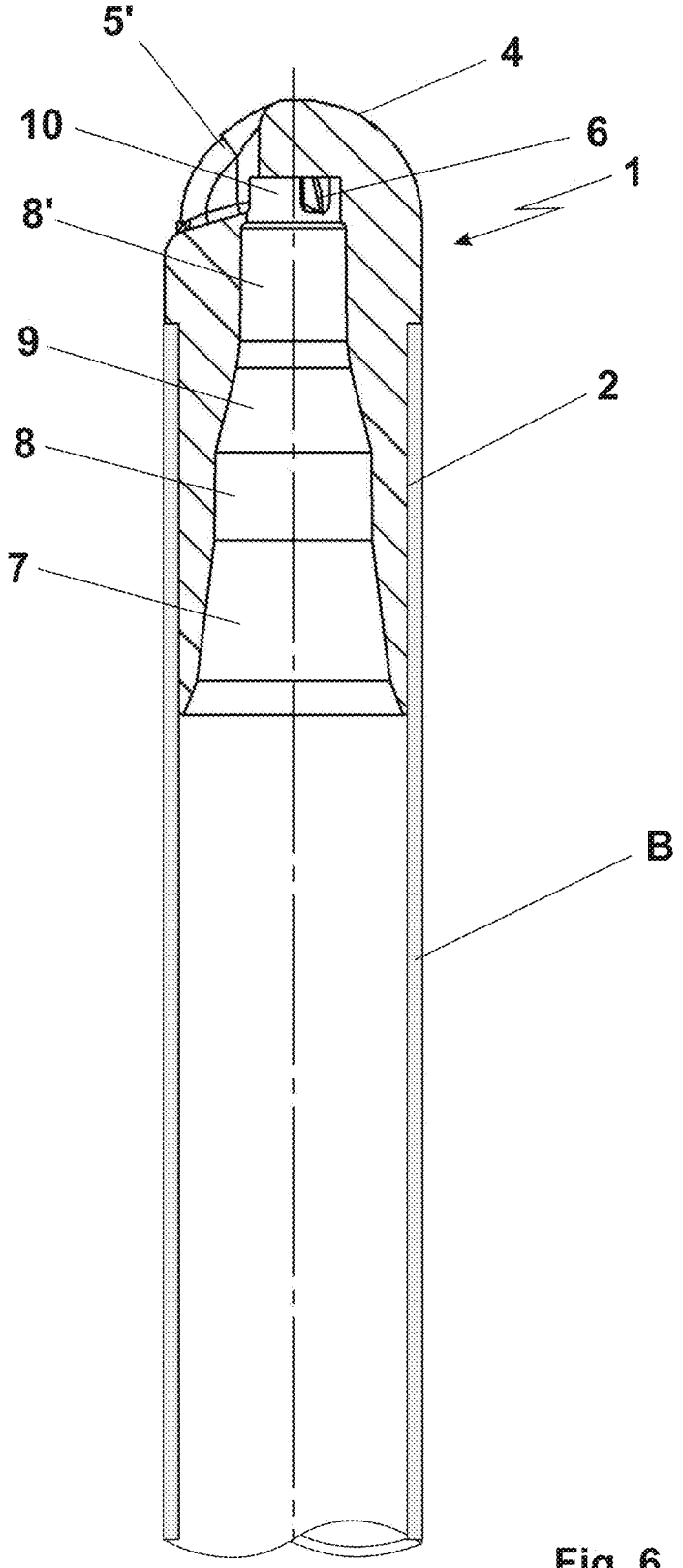
Figure 7:
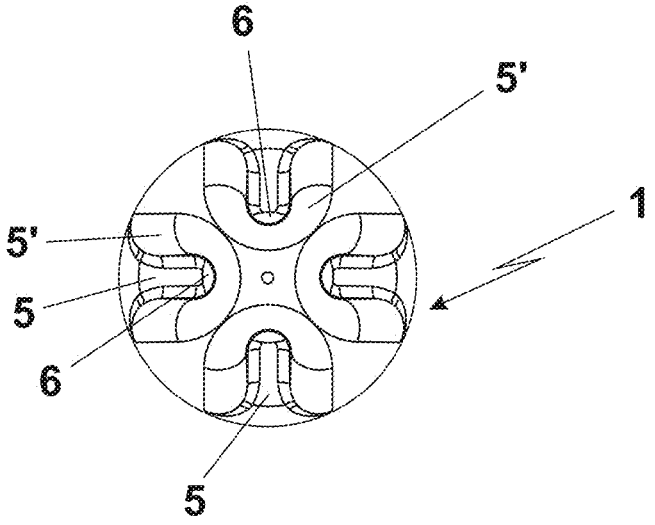
Figure 8:
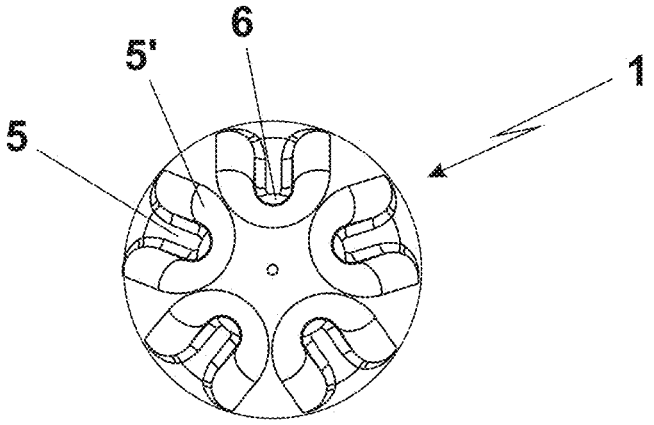
Figure 9:
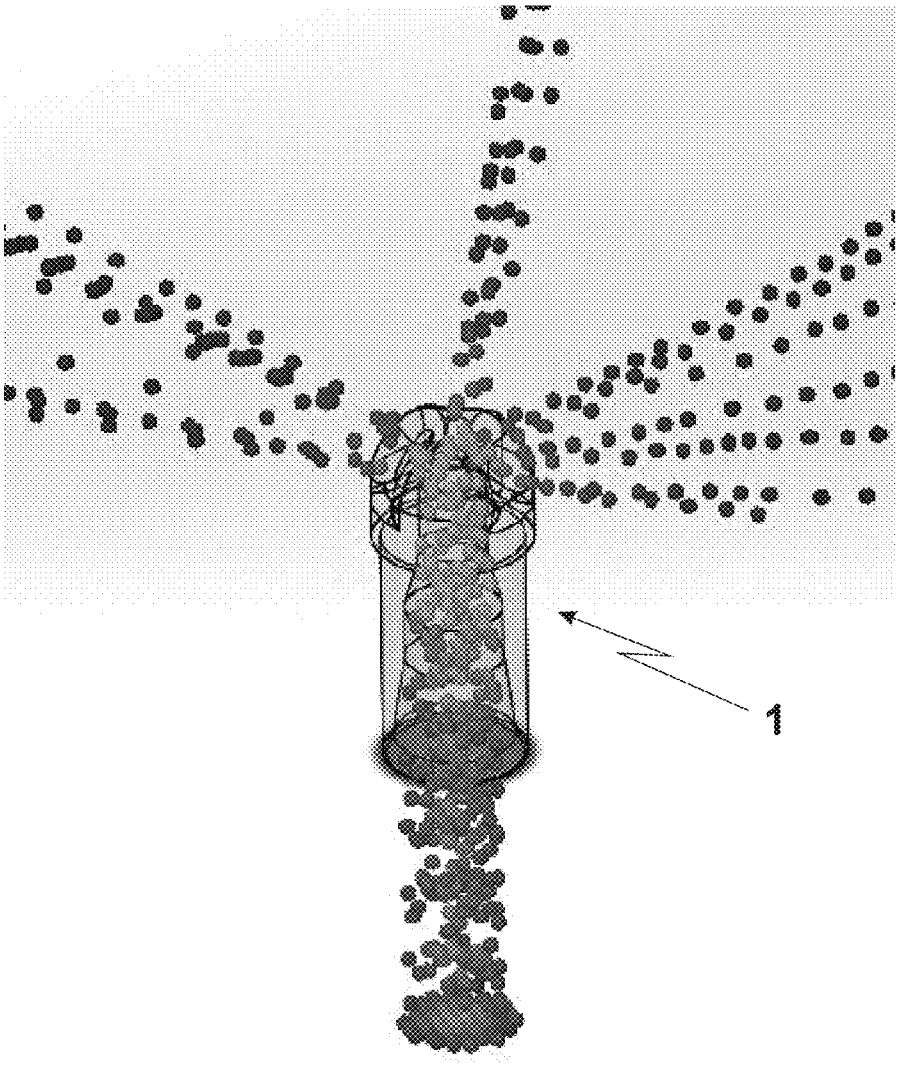

FIG. 2—front view of the tip of the artificial insemination device;

FIG. 3—side view of the tip of the artificial insemination device;

FIG. 4—top view of the tip of the artificial insemination device;

FIG. 5—bottom view of the tip of the artificial insemination device;

FIG. 6—sectional side view of the artificial insemination device including the tip and the tube;

FIG. 7—top view of a first constructive variant of the artificial insemination device, wherein the tip has four recesses and four orifices;

FIG. 8—top view of a second constructive variant of the artificial insemination device, wherein the tip has five recesses and five orifices;

FIG. 9—schematic perspective view of the application of the artificial insemination device.

According to FIGS. 1 to 6, the artificial insemination device, also referred to as an insemination sheath, comprises a tube B and a tip 1 engageable at one end of that tube B to be inserted into the animal's uterus. The tip 1 consists of a hollow tubular body with a semi-spherical upper end 4. The outer surface of the tubular body preferably presents a recessed region 2 and, at the lower end, a chamfer 3, both in an engaging region with the tube B, to facilitate coupling of the tip 1 within the tube B. The tip 1 may be glued, welded or threaded at the end of sheath B.

The tip A and the tube B are preferably made of polymeric or metallic material. The semi-spherical upper end 4 of the tip is provided with at least three orifices 6 for semen outlet.

In a preferred embodiment of this device, at the semi-spherical upper end 4 of the tip, at least three curved recesses 5' with U-shaped walls 5' are formed, wherein the outer edge of the walls 5' follows the semi-spherical curvature. Each one of these cavities is provided with one of the orifices 6. Preferably the three or more orifices are oriented sloped at least slightly upwardly, forming at an angle of less than 90° to the axis of the tube and the tip, to maintain the directing of the semen expelled into the uterine region, and the horns of the uterus.

In the embodiment shown in FIGS. 1 to 6, the tip is constituted of three curved recesses 5 and orifices, but according to other variants of the model, such a tip can be provided with four, five or more curved recesses 5 with orifices inclined upwards, as shown in FIGS. 7 and 8. The upwardly directed orifices 6 and the existence of several orifices, preferably evenly distributed in the region of the upper end 4 of the tip 1, are important to ensure the dispersion of the semen inside the animal's uterus more efficiently, increasing the spreading of the semen in the uterus and, consequently, the range area of the semen, which, consequently, increases the chances of fertilization of the ovum. In previously known devices which used only one or two laterally-oriented orifices, the dispersion range of the semen, when applied to the uterine cavity, was limited to the orientation of the orifices in the tip of the device after it had passed the animal's cervix.

The tip 1 has a hollow interior which communicates with the inside of the tube B, where a vane with biological material or a plunger is inserted, so that the biological material is distributed and dispersed inside the animal's uterus through the orifices of the tip.

Preferably, the hollow interior of the tip has a first frustoconical portion 7 whose broadest diameter faces the side of the tube and which tapers towards the upper end 4 of the tip 1 to facilitate the insertion of the vane with the biological material to be inseminated. This first frustoconical portion 7 is followed, in the direction of the upper end 4 of the tip 1, by a first annular portion 8, with a cylindrical profile, for stably housing the vane, upon application of the biological material therein. Following that first annular portion 8, the hollow interior of the tip further has at least a second additional frustoconical portion 9 tapering towards the upper end 4 of the tip, and whose larger diameter is located next to the first annular portion 8. The upper and lower diameters of this additional frustoconical portion 9 are, respectively, smaller than the upper and lower diameters of the first frustoconical portion 7. A second annular portion 8', with a diameter smaller than the diameter of the first annular portion 8, is provided after the second additional frustoconical portion 9, and before the niche 10. The hollow interior of the tip terminates in a niche 10 with the orifices 6 in the region of the semi-spherical upper end 4.

This assembly of the second additional frustoconical portion 9 followed by the second additional annular portion 8', both of smaller diameter, facilitates the insertion of a vane with the biological material having smaller dimensions than the assembly of the first frustoconical portion 7 with the first annular portion 8, as shown in FIG. 6. In this way, the tip of this device is compatible with vanes of different sizes, for instance, 0.50 ml and 0.25 ml.

Alternatively, the tip may comprise further assemblies of conical frustoconical portion followed by an annular portion with smaller diameter, disposed after the second frustoconical portion 9 and after the second additional annular portion 8' and before to the niche 10, to house even smaller vanes.

The better coupling between the vane with biological material and the artificial insemination device reduces the occurrence of reflux of the biological material when applied to the uterine cavity, said reflux that caused waste of biological material. To avoid this type of reflux, the application of the material should be carried out slowly. However, by better coupling between the vane and the insemination device, the application of the semen inside the uterine cavity can be performed quickly, generating jets with greater flow intensity and greater range, improving the dispersion of the biological material.

By virtue of this new arrangement of the device for artificial insemination, its use is very simple, it being sufficient to initially engage the end of the tube B in the recessed region of the tubular body 2 of the tip 1, which may also be glued, welded or threaded, and then insert the vane in the tube until its end engages one of the annular tips 8 or 8' of the tip, and the device is ready to be used. Hence, the biological material will follow the path of the vane being interrupted by the wall of the niche 10, which will direct it to the three or more orifices 6 so that the semen will be distributed in at least three different streams around the circumference of the tip. In case the orifices are tilted at least slightly upwards, the semen flows will flow forming at an angle of less than 90° with respect to the axis of the tube and the tip.

The artificial insemination device thus conceived provides the following advantages over its known counterparts:

- Greater peripheral reach, better targeting and better dispersion of biological material when passing through a larger number of orifices, which allows the flow of semen to the two uterine horns, regardless of the orientation of the tip when reaching the uterine cavity, improving the insemination results.
- Reduction of biological material waste inside the applicator device, due to the positioning and the number of orifices, as well as to the internal anatomy of the tip that provides a better housing of the vane. In known devices, a greater amount of biological material was trapped within the applicator device because of the reflux effect.
- Ease in the manufacturing process by means of plastic injection for the injected model, with low productive cost.
- The more anatomical shape with smoother curvatures at the upper end of the tip is less aggressive towards the animal at the time of introducing the tube through the cervix into the uterine cavity.

Thus, the scope of this utility model should not be limited to the constructive details, but rather to the terms defined in the claim and its equivalent.

What is claimed is:

1. An artificial insemination device, comprising: a tube, and a tip engageable at one end of said tube, the tip being formed by a hollow tubular body with a semi-spherical upper end, which comprises at least three orifices; the tip internally comprising at least a first frustoconical portion tapering towards the upper end for insertion of a first vane containing biological material to be inseminated, followed by a first annular portion for coupling the first vane, a second frustoconical portion tapering toward the upper end, arranged next to the first annular portion, and having upper and lower diameters respectively smaller than upper and lower diameters of the at least a first frustroconical portion, for insertion of a second vane containing biological material having a smaller diameter than the first vane, a second annular portion, having a diameter smaller than a diameter of the first annular portion, arranged after the second frustoconical portion, for coupling with the second vane, and a niche in a region of the semi-spherical upper end where the at least three orifices are arranged.

2. The artificial insemination device according to claim 1, wherein the at least three orifices are oriented at an angle smaller than 90° with respect to an axis of the tube and the tip.

3. The artificial insemination device according to claim 1, wherein the tip externally comprises at least three cavities having walls which are U-shaped, wherein in each of these cavities one of the at least three orifices is disposed.

4. The artificial insemination device according to claim 1, wherein the tip is attached to the one end of the tube by means of one of gluing, welding, or threading.

5. The artificial insemination device according to claim 1, wherein the at least three orifices are also evenly distributed over the semi-spherical upper end of the tip.

6. The artificial insemination device according to claim 1, wherein the tubular body is externally provided with a recessed region engaging the tube.

7. The artificial insemination device according to claim 2, wherein the at least three orifices are also evenly distributed over the semi-spherical upper end of the tip.

8. The artificial insemination device according to claim 3, wherein the at least three orifices are also evenly distributed over the semi-spherical upper end of the tip.

9. The artificial insemination device according to claim 4, wherein the at least three orifices are also evenly distributed over the semi-spherical upper end of the tip.

10. The artificial insemination device according to claim 2, wherein the tubular body is externally provided with a recessed region engaging the tube.

11. The artificial insemination device according to claim 3, wherein the tubular body is externally provided with a recessed region engaging the tube.

12. The artificial insemination device according to claim 4, wherein the tubular body is externally provided with a recessed region engaging the tube.

13. The artificial insemination device according to claim 5, wherein the tubular body is externally provided with a recessed region engaging the tube.

* * * * *